US005709560A

United States Patent [19]

Hio

[11] Patent Number: 5,709,560

[45] Date of Patent: Jan. 20, 1998

[54] CONNECTOR HAVING A PIVOTABLE CONNECTION-ASSISTANCE MEMBER

[75] Inventor: Masahide Hio, Yokkaichi, Japan

[73] Assignee: Sumitomo Wiring Systems, Ltd., Yokkaichi, Japan

[21] Appl. No.: 567,125

[22] Filed: Dec. 4, 1995

[30] Foreign Application Priority Data

| | | | |
|---|---|---|---|
| Dec. 14, 1994 | [JP] | Japan | 6-333357 |
| Dec. 28, 1994 | [JP] | Japan | 6-338389 |
| Dec. 28, 1994 | [JP] | Japan | 6-338390 |
| Dec. 28, 1994 | [JP] | Japan | 6-338393 |

[51] Int. Cl.[6] ..... H01R 13/62

[52] U.S. Cl. ..... 439/157; 439/680

[58] Field of Search ..... 439/152–160, 439/573, 372, 341, 342, 484, 680

[56] References Cited

U.S. PATENT DOCUMENTS

| | | | |
|---|---|---|---|
| 4,582,378 | 4/1986 | Fruchard | 439/157 |
| 5,241,451 | 8/1993 | Walburn et al. | 439/573 |
| 5,257,942 | 11/1993 | Taguchi | 439/157 |
| 5,344,194 | 9/1994 | Hatagishi et al. | 439/157 |
| 5,401,179 | 3/1995 | Shinchi et al. | 439/157 |
| 5,482,394 | 1/1996 | Shinchi et al. | 439/157 |
| 5,484,297 | 1/1996 | Takahashi et al. | 439/157 |
| 5,575,671 | 11/1996 | Katsuma | 439/157 |

FOREIGN PATENT DOCUMENTS

| | | |
|---|---|---|
| 4-62772 | 2/1992 | Japan . |
| 5-73875 | 10/1993 | Japan . |
| 6-29035 | 4/1994 | Japan . |
| 6-45275 | 6/1994 | Japan . |

*Primary Examiner*—Neil Abrams
*Assistant Examiner*—Brian J. Biggi
*Attorney, Agent, or Firm*—Oliff & Berridge P.L.C.

[57] ABSTRACT

A lever 40 is pivotally mounted on a female connector housing 21 through support shafts 27. A split groove 28 is formed in a distal end of the support shaft so as to elastically deform this distal end to reduce a diameter thereof. A retaining larger-diameter portion 29 is formed on this distal end, and a slanting guide surface is formed on a distal end of this larger-diameter portion 29. The lever 40 has support shaft insertion holes 43 for receiving the support shafts 27, respectively. An inner surface of the support shaft insertion hole 43 is enlarged in a stepped manner to provide a reception recess 44 for receiving the retaining larger-diameter portion 29 of the support shaft 27, and the retaining larger-diameter portion 29 is embedded in the lever 40. It is provided a wire cover 60 which is slidable in a direction perpendicular to the direction of pivotal movement of the lever 40. An engagement pawl 51 of the lever 40 engages a hook portion 65 of the wire cover 60 to thereby lock the lever 40 in the fitting completion position. In this condition, when the wire cover 60 is slidingly moved, the locking is released, and also cam projections 63 of the wire cover 60 urge the lever 40 upwardly to slightly pivotally move the pivotal movement member toward the fitting-starting position, thus enabling the finger to be easily engaged with the lever 40.

16 Claims, 12 Drawing Sheets

CONNECTOR HAVING A PIVOTABLE CONNECTION-ASSISTANCE MEMBER

BACKGROUND OF THE INVENTION

This invention relates to a connector in which two connectors are fitted together by pivotally moving a pivotal movement member.

One example of connectors of the type described is a lever-type connector disclosed in Japanese Patent Unexamined Publication No. 4-62772.

In the construction disclosed in this publication, a plurality of terminals are mounted on a male connector housing while a plurality of female terminals are mounted on a female connector housing. A lever, serving as a pivotal movement member for effecting a fitting operation, is mounted on the male connector housing for pivotal movement about support shafts. This lever is of a U-shape, and has arm portions at opposite sides thereof, and a cam groove is formed in the arm portion.

On the other hand, the female connector housing has cam-acting pins. When the two connectors are to be fitted together, the lever is held in a fitting-starting position, and in this condition the cam-acting pins on the female connector housing are engaged respectively in the cam grooves in the lever. Then, the lever is pivotally moved toward a fitting completion position, so that the female connector housing is displaced toward the male connector housing by a cam action of the cam grooves, thereby fitting the two connectors together.

In this kind of connector, in the process of fitting the two connectors together by pivotally moving the lever, there develops a large resistance to the manipulation of the lever because of the fitting between the male and female terminals and so on. For completely fitting the two connectors together, it is necessary to manipulate or operate the lever to move the same into the fitting completion position against this insertion resistance. However, if the force of pivotal operation of the lever is increased, an operating portion of the lever is flexed into an arcuate configuration, so that the arm portions are moved away from each other. This may result in a possibility that the arm portions become disengaged from the respective support shafts. In one known technique for preventing such a disadvantage, guide walls for preventing the movement of the arm portions away from each other are formed on the connector housing having the lever mounted thereon.

However, in the method of providing the guide walls, the width of the connector housing is increased by an amount corresponding to the widths of the guide walls, thus inviting a problem that the overall size of the connector housing is increased.

It may be proposed to provide a retaining washer on each support shaft of the lever. However, this increases the number of the component parts, and also lowers the assembling efficiency.

In order to positively maintain this connector-fitted condition, there is provided a lever lock mechanism for holding the lever in the fitting completion position. In this lock mechanism, an elastic pawl is formed integrally on the connector housing through a leg, and a distal end of this elastic pawl is engaged in a retaining recess formed in the lever.

In the above construction, for disconnecting the two fitted connectors from each other, the elastic pawl of the lever lock mechanism is first pivotally moved resiliently to release the engagement to thereby enable the pivotal movement of the lever, and then the lever is held at its distal end portion by the fingers, and is pulled upwardly.

However, in such an operation, even if the locking by the lever lock mechanism is released, the lever will not rise to a position where the lever can be easily engaged by the finger, and therefore the lever must be forcibly opened with the other hand. Thus, the above operation can not be carried out with one hand. Therefore, there has been encountered a problem that after the connector is mounted in a narrow space within an equipment, it is very difficult to disconnect the connectors from each other.

To overcome such a problem, there has been proposed a construction as disclosed in Japanese Utility Model Unexamined Publication 6-45275 (1994) in which a return spring is mounted on a lever, and when the locking by a lever lock mechanism is released, the lever is pivotally moved upwardly by the return spring. With this construction, however, the return spring must be mounted on the lever, and the construction becomes complicated, and the time and labor required for the manufacture increase, and as a result the cost is greatly increased.

In the conventional lever lock mechanism, the direction of pivotal movement of the lever is the same as the direction of pivotal movement of the elastic pawl, and therefore when a strong force is applied to the lever to urge the same in a direction toward the fitting-starting position, the elastic pawl is elastically deformed in an escaping manner, so that the engagement can be easily released, and therefore there is a possibility that the lever is allowed to pivotally move freely. It is possible to increase the rigidity of the elastic pawl to make the same less elastically deformable, but with such a construction, a large operating force is required for engaging the elastic pawl with the lever and for releasing the locking, which results in a problem that the efficiency of the operation is greatly lowered.

Further, in this kind of connector, for fitting the two connectors together, it is necessary to accurately set the lever in the fitting-starting position so that the cam projections can be properly engaged in the cam grooves, respectively. Therefore, it has heretofore been proposed to provide a retaining mechanism between the lever and the connector housing which retaining mechanism utilizes, for example, an elastic pawl.

However, in the construction provided with the above retaining mechanism, if the retaining force for the lever is weak, the lever may accidentally pivotally move during transportation of the connector or during the connector fitting operation. As a result, the lever is displaced from the initial position, that is, the fitting-starting position, so that the cam projections are out of registry with the respective cam grooves in the pivotal movement member, and the connectors can not be fitted together. Therefore, the lever must be reset in the fitting-starting position, and then the fitting operation is carried out, thus inviting a problem that considerable time and labor are required for such operation. To avoid this, it may be proposed to increase the retaining force for the lever. In this case, however, the lever can not be easily operated for pivotal movement because of the increased retaining force applied by the elastic pawl. This adversely affects the connector-fitting operability.

Furthermore, in this kind of connector, for effecting the connector-connecting operation, the cam-acting pins are first inserted into the cam grooves, respectively, and in this condition the lever is pivotally moved to move each cam-acting pin along the associated cam groove. Therefore, when the lever is to be pivotally moved, the cam-acting pins need to be positively received in the cam grooves, respectively.

Therefore, in the conventional construction, engagement pawls for engagement with each other are formed at the fitting portions of the male and female connector housings, and the two connectors are held in a provisionally-fitted condition by these engagement pawls, and in this condition the lever is pivotally moved.

However, wall portions of the two connectors have low flexibility, and in the above construction a sufficient amount of engagement between the two connectors can not be secured, and therefore the provisionally-retaining force is liable to be varied, which has resulted in a problem that the connector-connecting operation can not be carried out in a stable manner. To deal with this problem, if the connector is so designed as to provide a sufficient engagement amount, the two connector housings tend to be pre-fitted together rather unduly, which results in a problem that the engagement portion is plastically deformed, so that the connector fails to be repeatedly used. It may be possible to increase the size of the engagement pawl to increase the flexibility; however, this invites a problem that the overall size of the connector is increased.

SUMMARY OF THE INVENTION

A first object of this invention is to provide a connector in which a fitting assistance member is prevented from disengagement from a connector housing with a simple construction.

A second object of the invention is to provide a connector in which a pivotal movement member can be easily pivotally moved from a fitting completion position so as to disconnect two connectors from each other. Further, it is prevented the pivotal movement member from being accidentally pivotally moved from the fitting completion position to a fitting-starting position.

A third object of this invention is to provide a connector in which a pivotal movement member such as a lever is positively prevented from being accidentally pivotally moved from a fitting-starting position before connectors are fitted together, and despite this the resistance to the pivotal movement of the pivotal movement member is not increased, thereby providing an excellent connector-fitting operability.

A fourth object of this invention is to provide a connector in which two connectors can be held in a provisionally-fitted condition without increasing the size of the connector, and an excellent fitting operability is achieved.

According to the first aspect of the present invention, there is provided a connector wherein a support shaft is formed on and projects from a connector housing of one of two connectors to be fitted together; and a fitting assistance member for fitting the two connectors together and for disconnecting them from each other is pivotally mounted on the support shaft; in that a split groove is formed in a distal end of the support shaft so that the distal end can be elastically deformed to be reduced in diameter; and a retaining larger-diameter portion is formed at that portion of the support shaft inserted into a support shaft insertion hole formed in the fitting assistance member, a diameter of the retaining larger-diameter portion being larger than an inner diameter of the support shaft insertion hole.

An inner surface of the support shaft insertion hole may be enlarged in a stepped manner to provide a reception recess receiving the retaining larger-diameter portion of the support shaft. A tapering slanting guide surface may be formed at a distal end of the retaining larger-diameter portion, an outer diameter of a distal end of the tapering slanting guide surface being smaller than the inner diameter of the support shaft insertion hole.

The fitting assistance member is mounted on the connector housing through the support shaft, and in this condition the fitting assistance member is pivotally moved to fit the two connectors together. Even if a large fitting resistance acts on this fitting assistance member, so that the fitting assistance member is flexed and deformed in a direction apart from the support shaft, the fitting assistance member is prevented from disengagement from the support shaft since the retaining larger-diameter portion is formed on the distal end portion of the support shaft inserted in the support shaft insertion hole. The split groove is formed in the distal end of the support shaft so as to elastically deform this distal end to reduce its diameter, and therefore when the fitting assistance member is to be attached to the connector housing, it is only necessary to press a distal end portion of the fitting assistance member in a direction to press-fit the support shaft into the support shaft insertion hole, so that the support shaft is reduced in diameter because of the provision of the slit groove. Thus, the fitting assistance member can be easily attached to the connector housing despite the provision of the retaining larger-diameter portion on the support shaft.

Further, since the reception recess is formed in the fitting assistance member, the retaining larger-diameter portion at the distal end of the support shaft is received in the reception recess, and will not be projected from the side surface of the fitting assistance member. Furthermore, since the tapering slanting guide surface is formed on the retaining larger-diameter portion of the support shaft, this slanting guide surface guides the insertion of the support shaft into the support shaft insertion hole.

According to the second aspect of the invention, there is provided a construction wherein a pivotal movement member is mounted on a connector housing of one of two connectors to be fitted together, and can be operated to be pivotally moved between a fitting-starting position and a fitting completion position; and by pivotally moving the pivotal movement member, the two connectors are fitted together and disconnected from each other; characterized in that an auxiliary member is mounted on the one connector housing for displacement in a direction intersecting a direction of pivotal movement of the pivotal movement member; a lock mechanism for engagement with the pivotal movement member disposed in the fitting completion position to lock the pivotal movement member in the fitting completion position is provided on the auxiliary member and the pivotal movement member; and by displacing the auxiliary member, the lock mechanism is caused to effect a locking operation and a lock release operation.

Further, there is provided a construction wherein by pivotally moving a pivotal movement member, two connectors are fitted together and disconnected from each other; characterized in that an auxiliary member is mounted on one of connector housings for displacement; a cam mechanism portion is provided between the auxiliary member and the pivotal movement member so as to displace the pivotal movement member from a fitting completion position toward a fitting-starting position in accordance with a displacement of the auxiliary member.

Furthermore, the auxiliary member may serve also as a wire cover for covering wires extending from the one connector housing. The one connector housing and the auxiliary member may be provided with a retaining mechanism for holding the lock mechanism in its lock-operative condition through the auxiliary member.

The pivotal movement member is held in the fitting completion position by the lock mechanism. The auxiliary member for causing the lock mechanism to effect the locking operation and lock release operation is displaceable in the direction intersecting the direction of pivotal movement of the pivotal movement member. Therefore, even if a strong force is applied to the pivotal movement member in a direction toward the fitting-starting position, the auxiliary member will not be moved in a direction to release the locking, thus positively holding the pivotal movement member in the locked condition.

When the auxiliary member is displaced, the pivotal movement member is pivotally moved from the fitting completion position toward the fitting-starting position by the cam mechanism portion, thus effecting an initial step for the full pivotal movement of the pivotal movement member.

Since the auxiliary member serves also as the cover for the wires, the number of the component parts is reduced. Since there is provided the retaining mechanism for locking the operating member in the fitting completion position, the operating member is less liable to be displaced, and therefore the pivotal movement member is more positively prevented from being pivotally moved accidentally.

According to the third aspect of the present invention, there is provided a connector wherein a pivotal movement member is mounted on a connector housing of one of two connectors to be fitted together, and can be operated to be pivotally moved from a fitting-starting position to a fitting completion position; by pivotally moving the pivotal movement member, the two connectors are fitted together and disconnected from each other; and a retaining mechanism for holding the pivotal movement member in the fitting-starting position is provided between the one connector housing and the pivotal movement member; characterized in that the retaining mechanism is constituted by an elastic projection, which is formed integrally with and projects from the pivotal movement member, and extends in a direction of fitting between the two connectors, and an engagement hole for receiving the elastic projection, which engagement hole is formed in the one connector housing, and extends in the direction of fitting between the two connectors, the elastic projection being engaged in the engagement hole when the pivotal movement member is disposed in the fitting-starting position; and the other connector housing has an engagement release piece portion which enters the engagement hole to remove the elastic projection from the engagement hole when the two connectors are fitted together, thereby achieving a non-held condition.

Since the pivotal movement member is held in the fitting-starting position by the retaining mechanism, the pivotal member is prevented from being accidentally pivotally moved from the fitting-starting position before the connectors are fitted together. When the two connector housings are fitted together, the engagement release piece portion of the other connector housing enters the engagement hole in the one connector housing to remove the elastic projection from the engagement hole. As a result, the pivotal movement member is in a non-held condition, and therefore is allowed to pivotally move.

According to the fourth aspect of the present invention, there is provided a connector wherein a pivotal movement member is pivotally mounted on a connector housing of one of two connectors to be fitted together; a cam-acting pin is formed on the other connector, and is engageable in a cam groove formed in the pivotal movement member; by fitting the cam-acting pin into a provisionally-fitted position in the cam groove, the two connectors are held in a provisionally-fitted condition; and the two connectors are completely fitted together by a cam action achieved by the cam-acting pin and the cam groove in accordance with the pivotal movement of the pivotal movement member; characterized in that a provisionally-retaining projection is formed on the pivotal movement member, and projects into the cam groove, the provisionally-retaining projection being elastically retracted to allow the cam-acting pin to be fitted into the provisionally-retaining position when the cam-acting pin is press-fitted into the cam groove; and a recess or a through hole is formed in the pivotal movement member adjacent to the provisionally-retaining projection so as to facilitate an elastic compressive deformation of the provisionally-retaining projection.

In the above construction, an axis of pivotal movement of the pivotal movement member can be disposed on a line passing through the provisionally-fitted position along a direction of fitting of the two connectors.

In the above construction, when the two connectors are to be fitted together, the two connector housings are first slightly fitted together, so that the cam-acting pin is introduced into the cam groove in the pivotal movement member to elastically retract the provisionally-retaining projection, and passes past this projection to reach the provisionally-fitted position. In this condition, the provisionally-retaining projection prevents the cam-acting pin from being withdrawn from the cam groove, and therefore the two connector housings are held in the provisionally-fitted condition. When the cam-acting pin passes past the provisionally-retaining projection, the provisionally-retaining projection is compressed or squeezed by the cam-acting pin. Since the recess or the through hole is formed adjacent to this projection, the provisionally-retaining projection can be easily elastically compressed or deformed, and therefore is prevented from being plastically deformed by undue compression.

Further, for example, even if the cam-acting pin, when forced into the provisionally-fitted position, strikes hard against an inner surface of the cam groove, or even if a force tending to fit the two connectors together is exerted during transfer of the connector, there will not develop an angular moment for rotating the pivotal movement member since the axis of pivotal movement of the pivotal movement member is disposed on the line passing through the provisionally-fitted position along the direction of fitting of the two connectors. Therefore, the pivotal movement member will not pivotally moved from the provisionally-fitted position.

DETAILED DESCRIPTION OF THE PREFERRED EMBODIMENTS

A preferred embodiment of the present invention will now be described with reference to FIGS. 1 to 12.

Construction of the Embodiment

Figure 1:
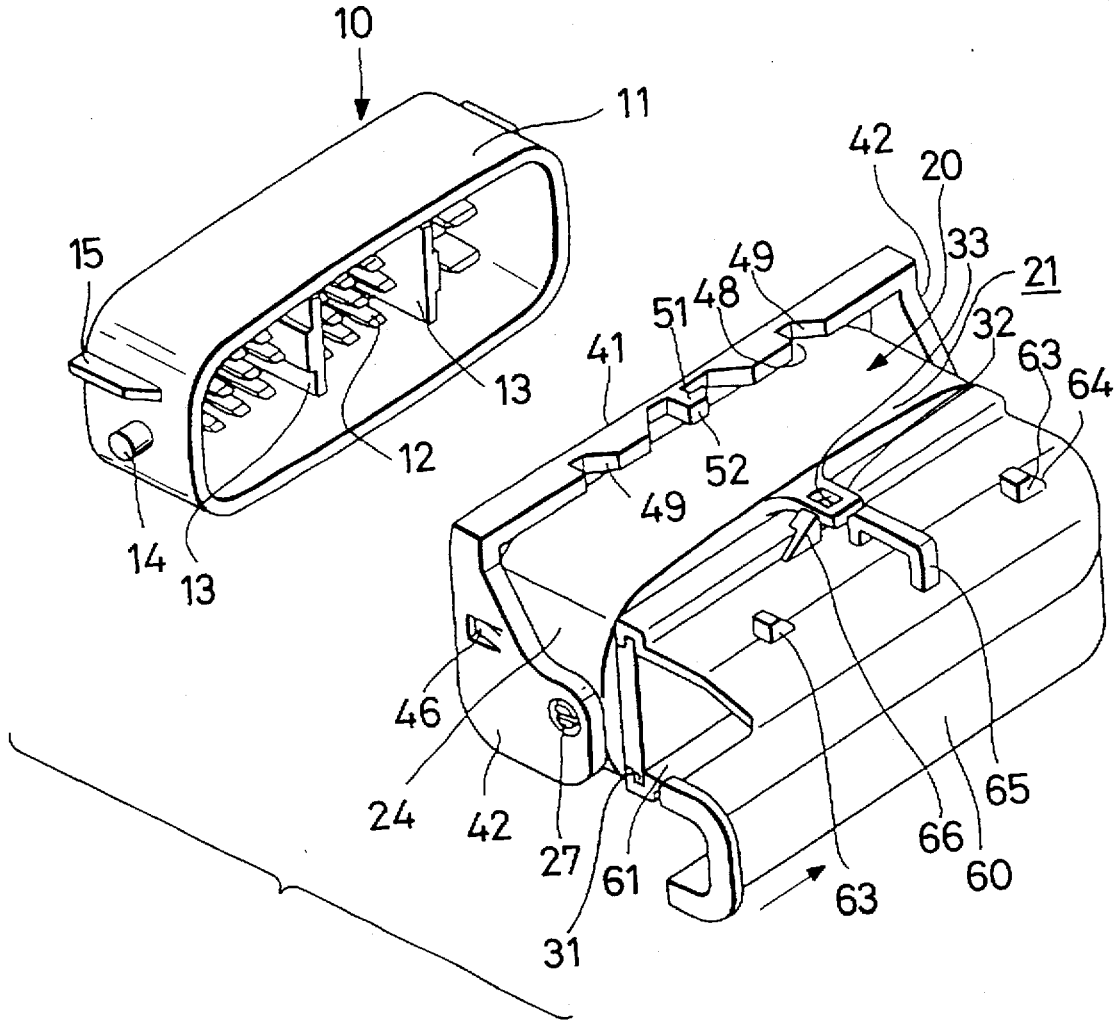
FIG. 1 is a perspective view of one preferred embodiment of the invention showing a condition before two connectors are fitted together.

Overall constructions of two connectors are shown in FIG. 1. The male connector 10 is shown in the left side of FIG. 1 while the female connector 20 is shown in the right side. The male connector 10 comprises a male connector housing 11 of a flattened, tubular shape which is open at one end, and is closed at the other end, and a plurality of male terminals 12 mounted within this connector housing 11. For example, two guide walls 13 are formed within the male connector housing 11, and extend toward the open end of this housing. The male terminals 12 comprises a group of large terminals of a larger current capacity, and a group of small terminals of a smaller current capacity, the two groups being disposed at different regions, respectively.

A pair of cam-acting pins 14 are formed respectively on opposite sides of the male connector housing 11 in coaxial relation to each other, and an engagement release piece portion 15 is formed on each side of this housing above the cam-acting pin 14.

Figure 2:
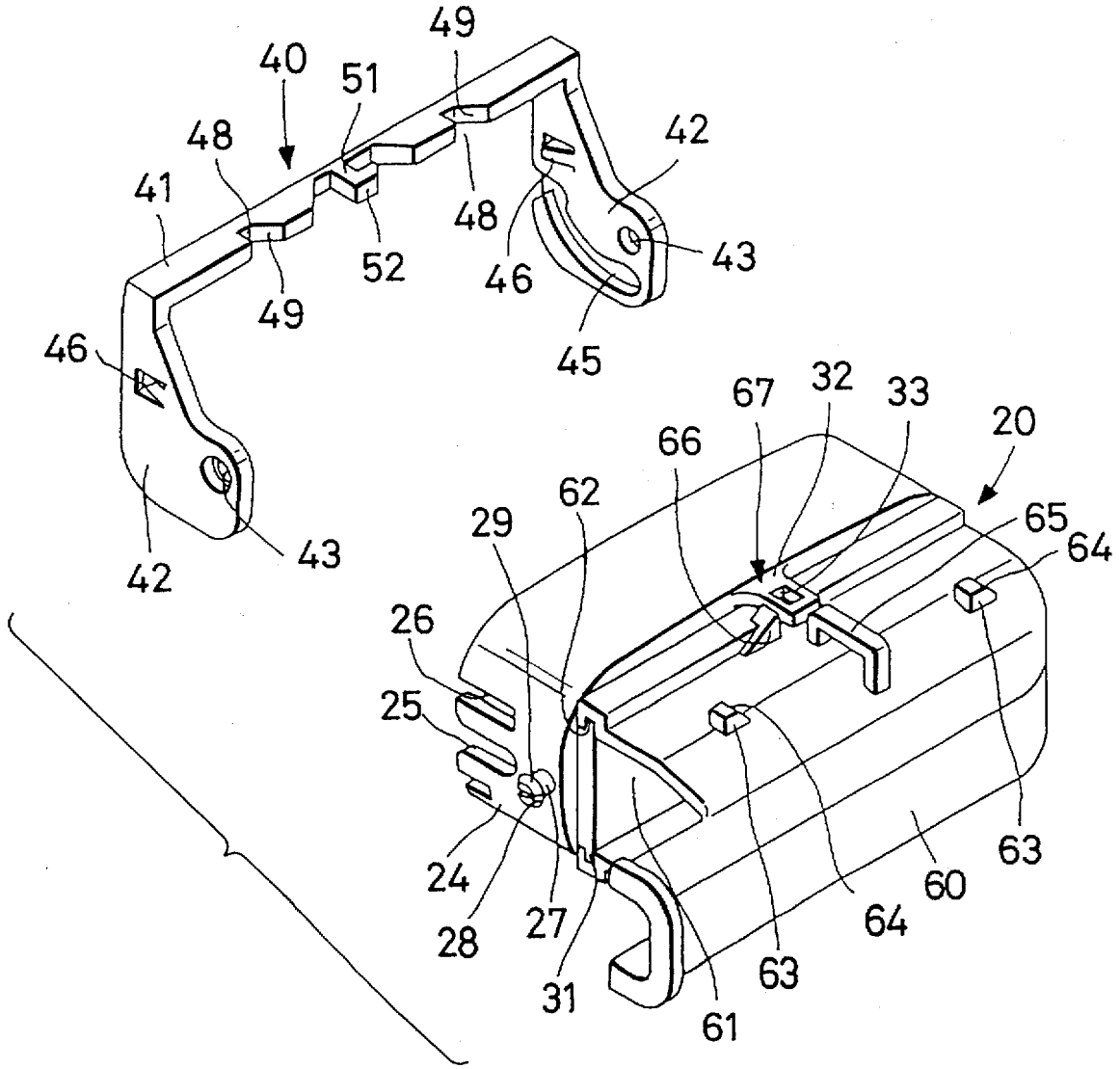
FIG. 2 is a perspective view of a female connector housing, with a lever detached therefrom.
Figure 3:
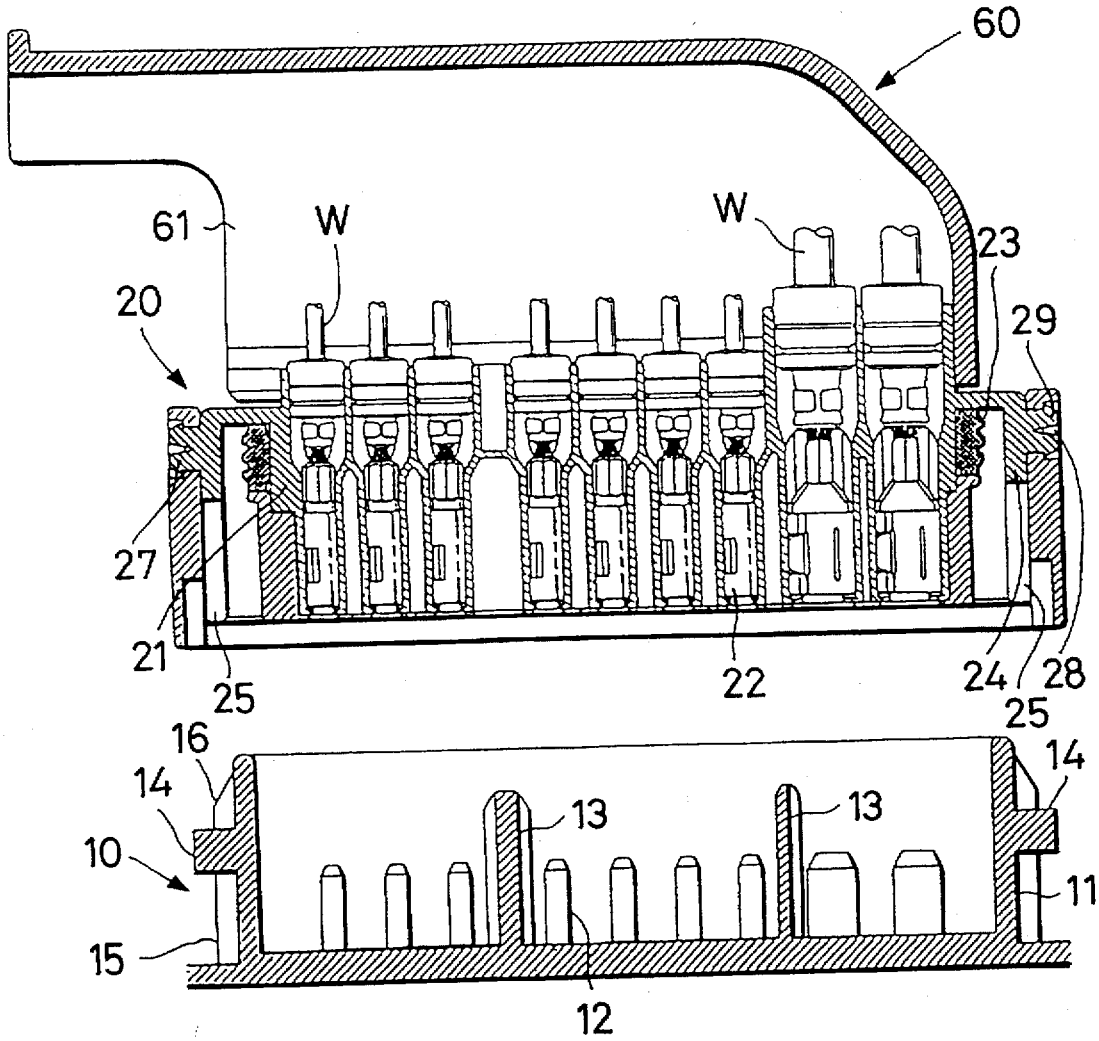
FIG. 3 is a cross-sectional view of the two connectors before they are fitted together.

On the other hand, the female connector 20 comprises a female connector housing 21 of a flattened, tubular shape, and a plurality of female terminals 22 mounted within this connector housing 21, as shown in FIG. 3. The female connector housing 21 can fit the male connector housing 11 on its outer peripheral portion. A waterproof seal member 23 is mounted on the outer peripheral portion of the female connector housing 21 at a proximal end portion thereof, and this seal member forms a seal between the female connector housing 21 and the male connector housing 11 when they are fitted together. A hood portion 24 for covering the outer periphery of the fitted male connector housing 11 is formed integrally with the female connector housing 21. The male connector housing 11 is adapted to be inserted into a space between the hood portion 24 and the female connector housing 21. A guide slit 25 and an engagement hole 26 are formed in each of opposite side walls of the hood portion 24 (see FIG. 2), and when the male connector housing 11 is inserted into the hood portion 24, the guide slit 25 and the engagement hole 26 receive the associated cam-acting pin 14 and the engagement release piece portion 15, respectively.

Figure 7:
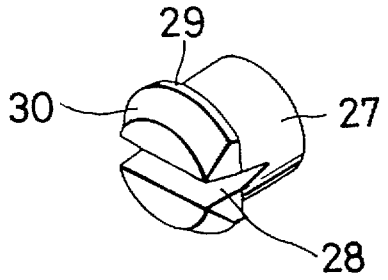
FIG. 7 is an enlarged, perspective view of a support shaft.
Figure 8:
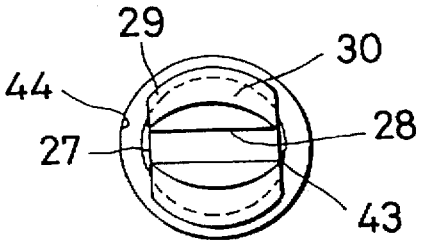
FIG. 8 is an enlarged, front-elevational view showing an insertion portion of the support shaft.
Figure 9:
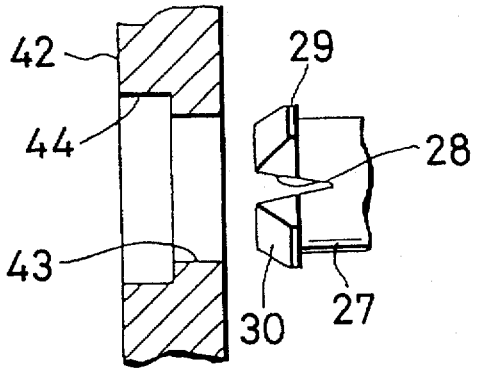
FIG. 9 is an enlarged, cross-sectional view showing a condition before the support shaft is inserted.

A pair of support shafts 27 for supporting a lever 40 (described later) are formed respectively on the opposite side walls of the hood portion 24 of the female connector housing 21 in coaxial relation to each other, each of the support shafts 27 being disposed on a line of extension of the guide slit 25. As shown in FIGS. 7 and 8, a split groove 28 of a V-shaped cross-section is formed in a distal end of the support shaft 27 to divide the same into two portions along the length thereof, so that the distal end portion of the support shaft 27 can be resiliently deformed to be reduced in diameter. A larger-diameter portion 29 for retaining purposes is formed on the distal end portion of the support shaft 27, and is larger in diameter than the proximal end portion thereof. The distal end of the support shaft 27 is formed into a tapering slanting guide surface 30, and is smaller in diameter than the proximal end portion of the support shaft 27. The retaining larger-diameter portion 29 is cut off at opposite side portions of the split groove 28 in a direction perpendicular to the split groove 28, so that the retaining larger-diameter portion 29 has a generally oval shape.

The lever 40, serving as a fitting assistance member, has a generally U-shape, and includes a bridge portion 41, and a pair of leg portions 42 extending respectively from opposite (right and left) ends of the bridge portion 41. Each leg portion 42 has a support shaft insertion hole 43 formed therethrough for passing the support shaft 27 therethrough, and the inner diameter of the support shaft insertion hole 43 is slightly larger than the outer diameter of the support shaft 27. The inner surface of the support shaft insertion hole 43 is enlarged in a stepped manner to form a reception recess 44 at an outer portion of this insertion hole 43 (which can face away from the male connector housing 11), the reception recess 44 serving to receive the retaining larger-diameter portion 29 of the support shaft 27. The support shafts 27 are passed respectively through the support shaft insertion holes 43, and support the lever 40 in such a manner that the lever 40 is pivotally movable about the support shafts 27 between "a fitting-starting position" shown in FIG. 1 and "a fitting completion position" shown in FIG. 4. In this supported condition, each retaining larger-diameter portion 29 is fully received in the associated reception recess 44, and therefore the distal end of the support shaft 27 is not projected from the lever 40.

Figure 25:
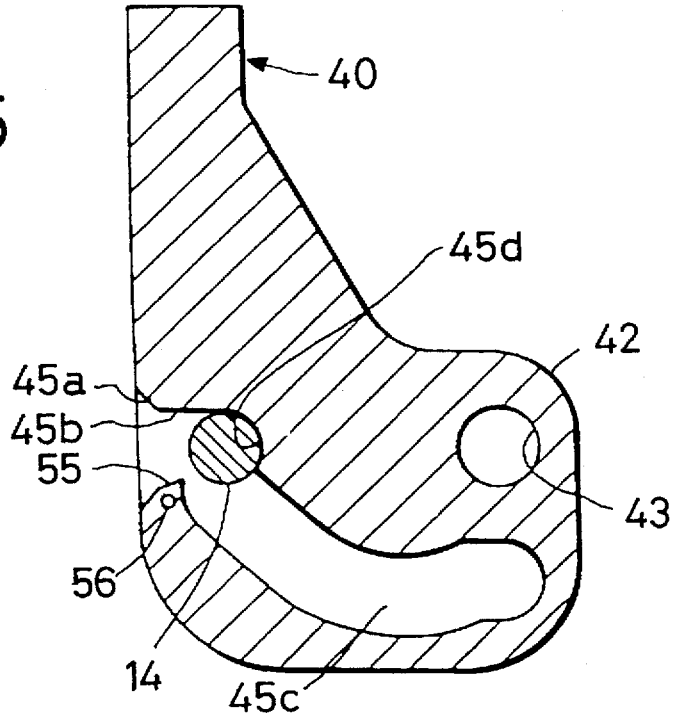
FIG. 25 is an enlarged, cross-sectional view of a leg portion of the lever.

A pair of cam grooves 45 are formed in the inner surface of the lever 40 (which can face the male connector housing 11) as shown in FIGS. 2 and 25, and when the male connector housing 11 is inserted, the cam-acting pins 14 are inserted into and engaged in the cam grooves 45, respectively. The cam groove 45 has an introduction passage **45*b* extending straight from an outer open end 45*a*, and an arcuate passage 45*c* extending arcuately from an inner end of the introduction passage 45*b*, the arcuate passage 45*b* gradually changing in curvature. When the lever 40 is disposed in the fitting-starting position, the outer open end 45*a* of each cam groove 45 is disposed in registry with the open end of the associated guide slit 25 formed in the hood portion 24 of the female connector housing 21, and the cam-acting pin 14 of the male connector housing 11 is introduced into the cam groove 45 through the outer open end 45*a*. The introduction passage 45*b* extends straight from the outer open end 45*a* toward the support shaft insertion hole 43 in the lever 40, and has a length about 1.5 times larger than the outer diameter of the cam-acting pin 14. The inner end of the introduction passage 45*b* serves as an impingement stopper wall portion 45*d* on which the cam-acting pin 14, introduced through the outer open end 45*a*, impinges, and the arcuate passage 45*c* extends from one side of the inner end of the introduction passage 45*b* in a curved manner. The cam-acting pin 14, introduced into the introduction passage 45*b*, impinges on the impingement stopper wall portion 45*d* to be stopped there. This stop position will hereinafter be referred to as "provisionally-fitted position", and the axis of pivotal movement of the lever 40 (that is, the center of the support shaft insertion hole 43**) is disposed on a line passing through the provisionally-fitted position along the direction of fitting of the two connectors.

A provisionally-retaining projection 55 is formed on the lever 40 adjacent to the outer open end **45*a* of each cam groove 45, and projects into the cam groove 45. The distance between the distal end of the provisionally-retaining projection 55 and that portion of the inner surface of the cam groove 45 facing the distal end of this projection 55 is smaller than the outer diameter of the cam-acting pin 14, and the cam-acting pin 14 is fitted into the introduction passage 45*b* while elastically deforming the provisionally-retaining projection 55. To facilitate the elastic compressive deformation of the provisionally-retaining projection 55, a recess 56 is formed adjacent to the provisionally-retaining projection 55. This recess 56 is formed by depressing the relevant portion of the leg portion 42 of the lever 40, and has a substantially circular shape as shown in FIG. 25**.

An elastic projection 46 is formed integrally with each leg 42 of the lever 40 at a proximal end portion thereof, and projects from the inner surface of the lever 40. When the lever 40 is in the fitting-starting position, each elastic projection 46 is fitted or engaged in the associated engagement hole 26 in the hood portion 24, and thus cooperates with the engagement hole 26 to provide a retaining mechanism for holding the lever 40 in the fitting-starting position.

A wire cover 60 (which corresponds to an auxiliary member in the invention) is mounted on the rear side of the female connector housing 21. This wire cover 60 covers a group of wires w (shown only in FIG. 3) connected respectively to the female terminals 22, and the group of wires w extend outwardly through a rear opening 61 (at the left side in FIG. 3). Mounting grooves 62 are formed in the inner surface of the wire cover 60 adjacent to the rear surface of the female connector housing 21, and are fitted respectively in elongate mounting protuberances 30 formed at the rear end of the female connector housing 21, thereby attaching the wire cover 60 to the female connector housing 21. The wire cover 60 is slidingly movable from the position shown in FIG. 1 in a direction indicated by an arrow.

A pair of cam projections 63 are formed on one side surface of the wire cover 60, and are spaced from each other along the length of the wire cover 60. Each cam projection 63 has a front slanting surface 64 facing in the direction of the arrow. Formed in the bridge portion 41 of the lever 40 are cam reception recesses 48 which receive the cam projections 63 of the wire cover 60, respectively, when the lever 40 is pivotally moved into the fitting completion position. Each cam reception recess 48 has a slanting surface 49 which is similar to the slanting surface 64 of the cam projection 63, and coacts with the slanting surface 64 of the associated cam projection 63. Therefore, when the wire cover 60 is moved in the direction of the arrow in the fitting completion position of the lever 40, the slanting surface 64 of each cam projection 63 urges the slanting surface 49 of the associated cam reception recess 48 upwardly, so that the lever 40 can be pivotally moved upwardly from the fitting completion position. The cam projections 63 and the cam reception recesses 48 jointly constitute a cam mechanism portion 50 for displacing the lever 40 from the fitting completion position toward the fitting-starting position.

An engagement pawl 51 of a generally L-shape is formed on a central portion of the bridge portion 41 of the lever 40, and a hook portion 52 formed at a distal end of this engagement pawl 51 extends toward the front side of the wire cover 60. A hook portion 65 of a U-shape is formed integrally with the wire cover 60, and is disposed midway between the cam projections 63. The engagement pawl 51 and the hook portion 65 cooperate with each other to provide a lock mechanism 54 for locking the lever 40. More specifically, when the wire cover 60 is moved to the locked position shown in FIG. 1 in the fitting completion position of the lever 40, the engagement pawl 51 of the lever 40 engages the hook portion 65 of the wire cover 60, thereby preventing the lever 40 from pivotal movement toward the fitting-starting position. When the wire cover 60 is moved in the direction of the arrow from the locked position to a lock release position (FIG. 5), the hook portion 65 is disengaged from the engagement pawl 51. The hook portion 52 extends straight along the bridge portion 41, and the surface of contact of the hook portion 52 with the hook portion 65 is disposed perpendicularly to the direction of pivotal movement of the lever 40.

Figure 13:
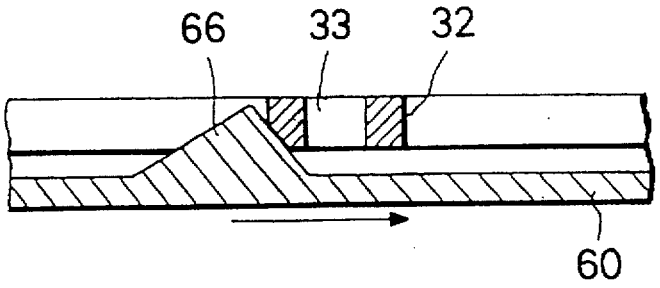
FIG. 13 is an enlarged, cross-sectional view showing a condition in which the wire cover is held under a lock-operative condition by a retaining mechanism.

A projection 32 is formed at a central portion of the rear side of the female connector housing 21, and is disposed in spaced, overlapping relation to the side surface of the wire cover 60. A retaining hole 33 is formed through the projection 32. A retaining projection 66 is formed integrally on that portion of the wire cover 60 corresponding to the projection 32. A distal end of the retaining projection 66 can fit in the retaining hole 33. These cooperate with each other to provide a retaining mechanism 67 for holding the wire cover 60 in the above locked position. The retaining projection 66 is in the form of a triangular plate two slanting sides, and in the locked position, the retaining projection 66 is held against one side of the projection 32 as shown in FIG. 13, thus preventing the lock cover 60 from moving from the locked position to the lock release position (that is, in a right direction in FIG. 13). When the wire cover 60 is forcibly moved in the direction of the arrow from the locked position to the lock release position, the distal end of the retaining projection 66 is fitted in the retaining hole 33.

Operation of the Embodiment

Figure 10:
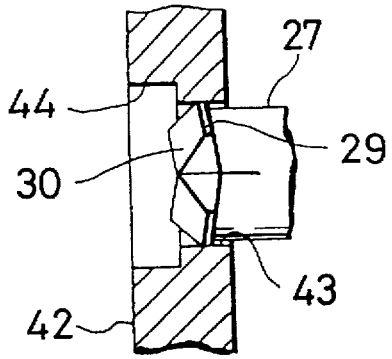
FIG. 10 is an enlarged, cross-sectional view showing the process of insertion of the support shaft.
Figure 11:
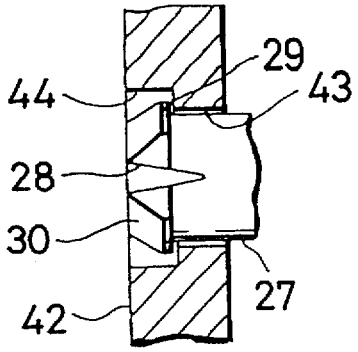
FIG. 11 is an enlarged, cross-sectional view showing a condition after the support shaft is inserted.

At first, mounting of the lever 40 to the female connector housing 21 is explained. In the above construction, for attaching the lever 40 to the female connector housing 21 in the condition shown in FIG. 2, the pair of opposed leg portions 42 of the lever 40 are first urged away from each other, and the support shaft insertion hole 43 of each leg portion 42 is brought into contact with the distal end of the associated support shaft 27. As a result, the slanting guide surface 30 at the distal end of the support shaft 27 is slightly inserted into the support shaft insertion hole 43 (see FIG. 9), and then the leg portion 42 of the lever 40 is urged toward the female connector housing 21. As a result, the retaining larger-diameter portion 29 of the support shaft 27 is elastically deformed to close the split groove 28, so that the support shaft 27 is allowed to be further inserted into the support shaft insertion hole 43 as shown in FIG. 10. The retaining larger-diameter portion 29, when received in the reception recess 44, is elastically restored into the initial configuration, as shown in FIG. 11. The two support shafts 27 are thus inserted into the respective insertion holes 43, thereby pivotally mounting the lever 40 on the female connector housing 21.

Next, for connecting the two connectors together, the lever 40 is held in the fitting-starting position shown in FIG. 1, and the cam-acting pins 14 of the male connector housing 11 are inserted respectively into the cam grooves 45 formed respectively in the leg portions 42 of the lever 40. Then, the lever 40, mounted on the female connector housing, is held at its bridge portion 41, for example, by the fingers, and is pivotally moved from the fitting-starting position to the fitting completion position shown in FIG. 4. As a result, each cam-acting pin 14 is moved toward the female connector housing 21 through the cam action jointly achieved by the cam-acting pin 14 and the cam groove 45, so that the male and female connectors are connected together.

At this time, as the insertion of the female connector housing 21 into the male connector housing 11 proceeds, the insertion load is increasing, and if a manipulating force applied to the bridge portion 41 is increased against this insertion load, the bridge portion 41 is flexed and deformed, thus producing a force to move the leg portions 42 away from each other. However, the diameter of the retaining larger-diameter portion 29, formed at the distal end of the support shaft 27, is larger than the inner diameter of the support shaft insertion hole 43, and therefore even when the two leg portions 42 are urged away from each other, the leg portions 42 will not be disengaged from the support shafts 27, respectively.

As described above, in this embodiment, the retaining larger-diameter portion 29 is formed at the distal end of each support shaft 27, and therefore even if a large insertion resistance is exerted when the two connectors are to be connected together, each support shaft 27 is positively prevented from being disengaged from the associated support shaft insertion hole 43. Moreover, there is no need to provide guide walls or retaining parts as in the conventional construction, and therefore this contributes to a compact design of the connector, and besides the number of the component parts is reduced, and the assembling operation is simplified, so that the manufacturing cost can be reduced.

And besides, particularly in this embodiment, since the reception recesses 44 for respectively receiving the retaining larger-diameter portions 29 of the support shafts 27 are formed in the lever 40, the support shafts 27 are entirely embedded in the lever 40, and do not project from the side surfaces of the lever 40, respectively, so that the overall construction of the connector can be further reduced in size. Furthermore, particularly in this embodiment, the tapering slanting guide surface 30, having the distal end whose outer diameter is smaller than the inner diameter of the support shaft insertion hole 43, is formed at the distal end of the support shaft 27. Therefore, when the support shaft 27 is to be inserted into the support shaft insertion hole 43, the distal end portion of the support shaft 27 is first slightly fitted in the inlet portion of the support shaft insertion hole 43, and then the leg portion 42 of the lever 40 is pressed toward the connector housing 21. Thus, despite of the provision of the retaining larger-diameter portion 29, the support shaft can be easily inserted into the support shaft insertion hole 43.

The present invention is not to be limited to the above embodiment, and for example, the following modifications can be made, and such modifications falls within the scope of the present invention.

Figure 12:
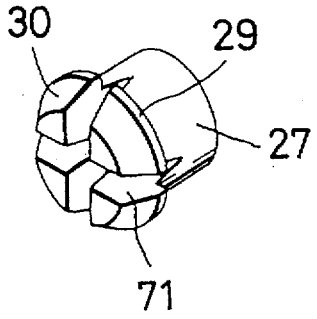
FIG. 12 is a perspective view of a modified support shaft of the invention.

In the above embodiment, although the split groove 28 in the support shaft 27 is straight, a cross-shaped split groove 71 may be formed as shown in FIG. 12. With this construction, the elastic deformability is enhanced, and therefore there is obtained an advantage that the insertion of the support shaft 27 can be effected more easily.

In the above embodiment, although the split groove 28 has a V-shaped cross-section, it may has a U-shaped or channel-shaped cross-section, and a plurality of split grooves may be formed.

Furthermore, the fitting assistance member is not limited to the lever shown in the above embodiment, and for example it may comprise a simple flat plate having only one leg portion, or may comprise a disk-shaped plate having a pivotal movement-operating portion and a cam-acting portion. In short, the fitting assistance member is applied to the connector in such a manner that it is pivotally mounted on one of the connector housings through the support shaft for fitting the two connectors together and for disconnecting them from each other.

Figure 4:
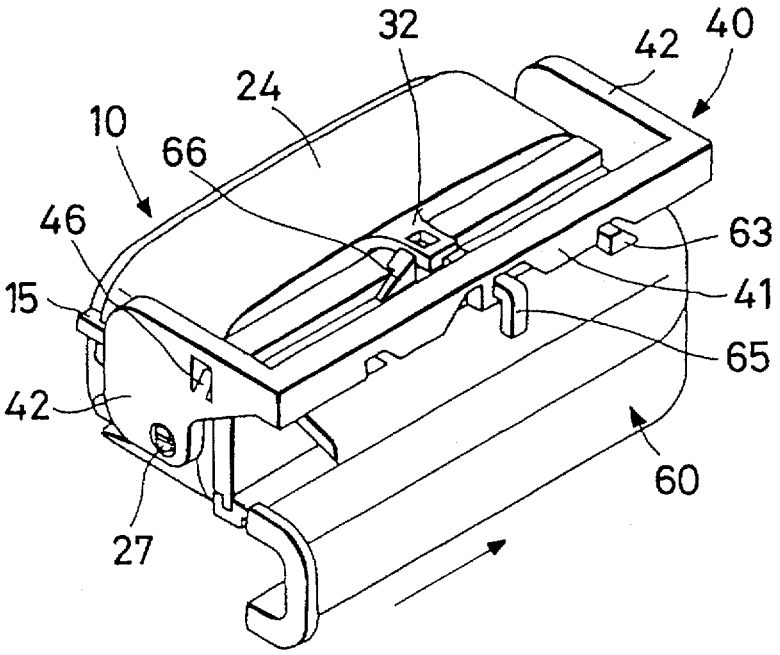
FIG. 4 is a perspective view of the female connector housing, with the lever locked in a fitting completion position.
Figure 5:
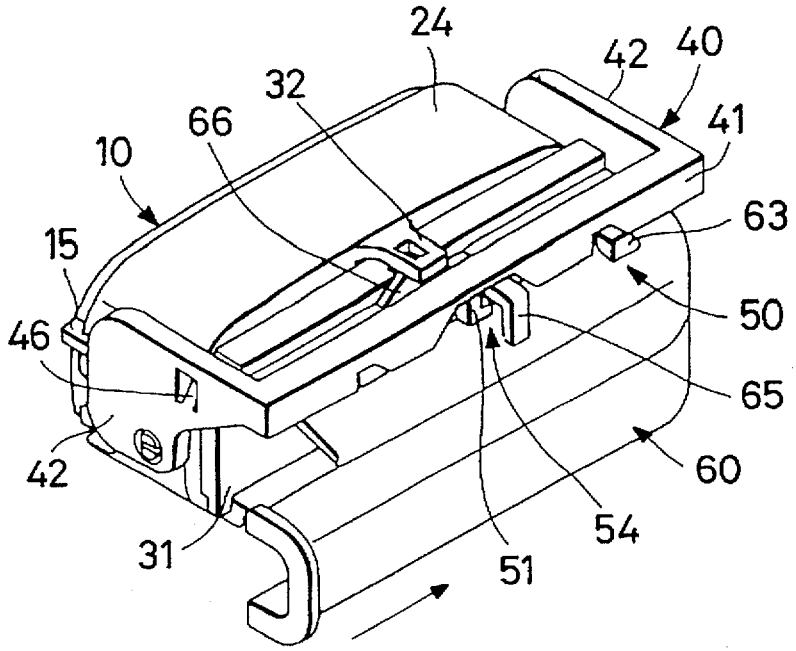
FIG. 5 is a perspective view of the female connector housing, with a wire cover moved to a lock release position.

Next, the lock mechanism for the lever 40 will be explained hereinafter. It is assumed that the two connectors are fitted together as shown in FIG. 4 and that the lever 40 is held in the fitting completion position by the lock mechanism 54. In this condition, when a strong force is applied to the lever 40 to urge the same in the direction toward the fitting-starting position, the hook portion 52 of the engagement pawl 51 of the lever 40 strongly pushes the lower surface of the hook portion 65 of the wire cover 60 upwardly. However, the wire cover 60 is movable in the direction perpendicular to the direction of pivotal movement of the lever 40, and the area of contact between the hook portion 52 and the hook portion 65 is disposed perpendicular to the direction of pivotal movement of the lever 40. Therefore, the wire cover 60 will not move or escape in the direction of lock release of the lock mechanism 54. Moreover, since the wire cover 60 is held in the locked position by the retaining mechanism 67 constituted by the retaining projection 66 and the projection 32, the movement in the lock release direction is positively prevented.

Figure 6:
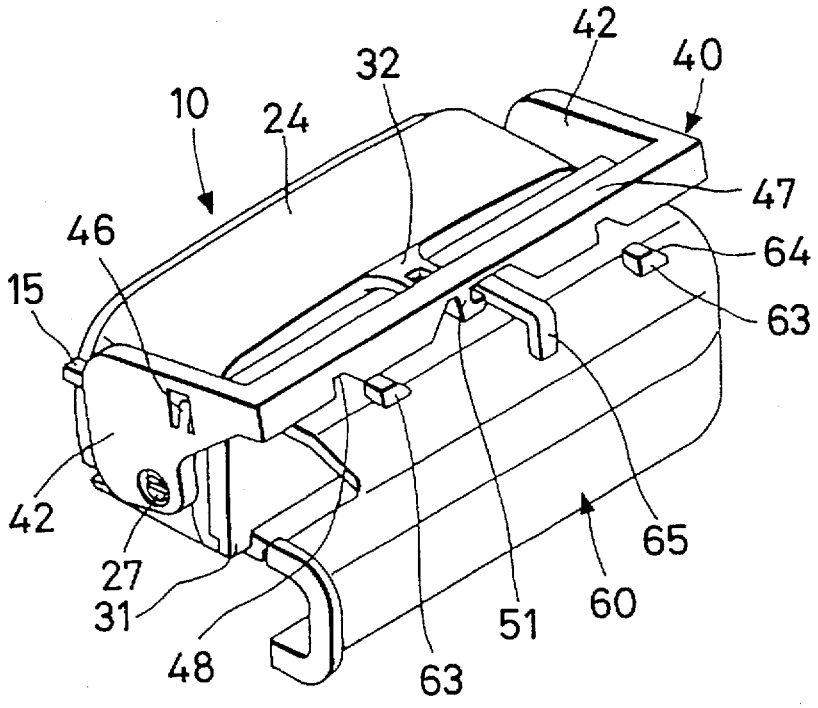
FIG. 6 is a perspective view of the female connector housing, with the wire cover further forwardly moved from the lock release position.
Figure 14:
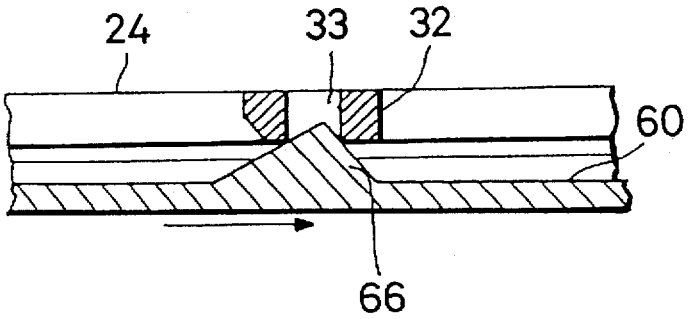
FIG. 14 is an enlarged, cross-sectional view showing a condition in which the wire cover reaches the lock release position.

In this condition, for disconnecting the two connectors from each other, the wire cover 60 is moved from the position shown in FIG. 4. More specifically, the wire cover 60 is moved from the locked position (FIG. 13) to the lock release position (FIG. 14). At this time the retaining projection 66 elastically deforms the projection 32 of the female connector housing 21 upwardly. Therefore, in the lock mechanism 54, the hook portion 65 is moved from the position of FIG. 15 into the position of FIGS. 5 and 16, and hence is disengaged from the engagement pawl 51 of the lever 40, thus allowing the pivotal movement of the lever 40. When the wire cover 60 is further moved, the slanting surface 64 of each cam projection 63 abuts against the slanting surface 49 of the associated cam reception recess 48 of the lever 40, and forcibly urges the same upwardly. As a result, as shown in FIGS. 6 and 17, the lever 40 is slightly moved from the fitting completion position toward the fitting-starting position, and is stopped there, so that there is formed a gap between the lever 40 and the wire cover 60. Therefore, the lever 40 can be easily held by the finger, and hence can be operated even with one hand, and a subsequent pivotal movement of the lever 40 toward the fitting-starting position can be easily effected.

As described above, in this embodiment, the direction of movement of the wire cover 60 (which constitutes the lock mechanism 54 for the lever 40) intersects the direction of pivotal movement of the lever 40, and therefore even if a strong pivotal movement-causing force is applied to the lever 40 disposed in the fitting completion position, the wire cover 60 is prevented from escaping in the lock-releasing direction. This positively prevents the fitting between the two connectors from being accidentally released, and the reliability in maintaining the fitting is enhanced.

When the lever 40 is to be moved from the fitting completion position to the fitting-starting position so as to release the fitting between the connectors, the wire cover 60 is first slidingly moved, so that the lever 40 is pivotally moved into the position where the finger can be easily engaged with the lever 40. Then, the finger is engaged with the lever 40, and the lever 40 is raised by this finger. Therefore, even if the connectors are mounted in a narrow space within the equipment, the connectors can be disconnected from each other with one hand, and maintenance and other operations can be carried out quite easily.

Moreover, in this embodiment, since the lock mechanism 54 is provided utilizing the wire cover 60, the number of the component parts is smaller as compared with a construction in which additional parts for such a lock mechanism are used, and therefore the manufacturing cost can be reduced.

Figure 18:
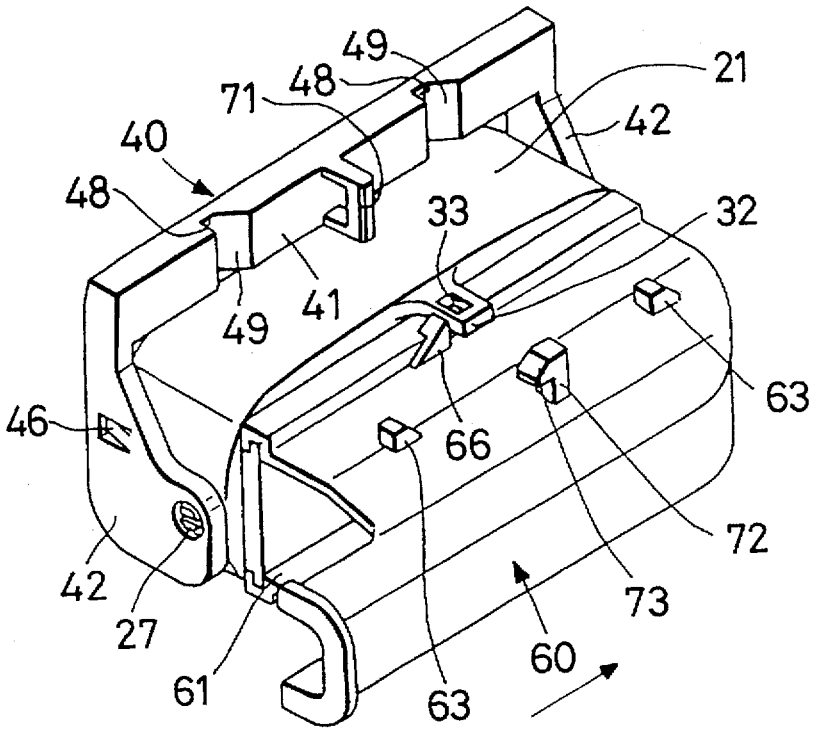
FIG. 18 is a perspective view of a second embodiment of the invention, showing a female connector.

FIG. 18 shows a second lock mechanism of the present invention which differs from the above described specific construction of a lock mechanism for locking a lever in a fitting completion position. The other construction is similar to that of the first embodiment, and therefore identical portions are designated by identical reference numerals, respectively, and detailed explanation thereof will be omitted, and only different portions will be described.

A hook portion 71 of a U-shape is formed on and projects from a bridge portion 41 of the lever 40 at a central portion thereof, and an engagement pawl 72 of an L-shape engageable with the hook portion 71 is formed on and projects from a wire cover 60. A hook portion 73 of the engagement pawl 72 extends toward a rear opening 61 of the wire cover 60. The wire cover 60 is attached to a female connector housing 21, and then when the lever 40 is pivotally moved into the fitting completion position, the lever 40 is locked there. Then, when the wire cover 60 is slidingly moved in a direction of an arrow, the engagement pawl 72 is disengaged from the hook portion 71, thereby releasing the locking of the lever 40.

With this construction, effects similar to those of the first embodiment can be achieved, and besides there is achieved an advantage that the bridge portion 41 of the lever 40 has a higher strength as compared with the first embodiment.

Figure 19:
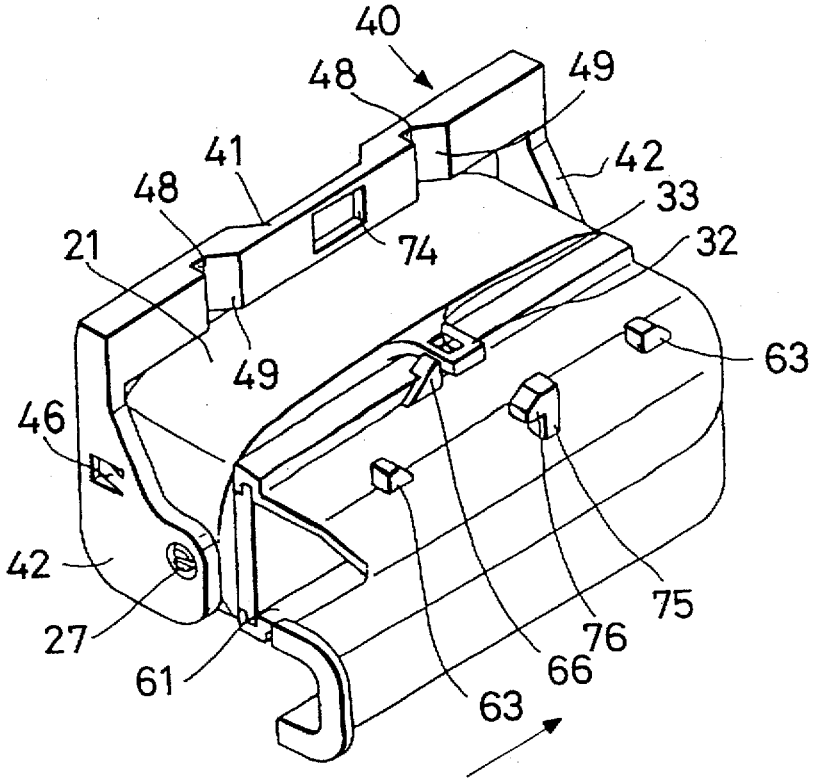
FIG. 19 is a perspective view of a third embodiment of the invention, showing a female connector.
Figure 20:
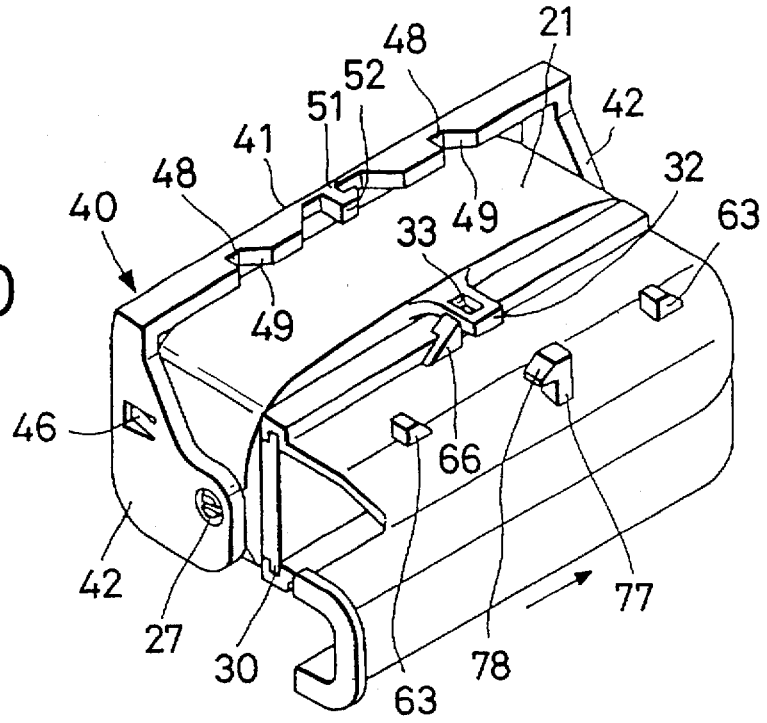
FIG. 20 is a perspective view of a fourth embodiment of the invention, showing a female connector.
Figure 21:
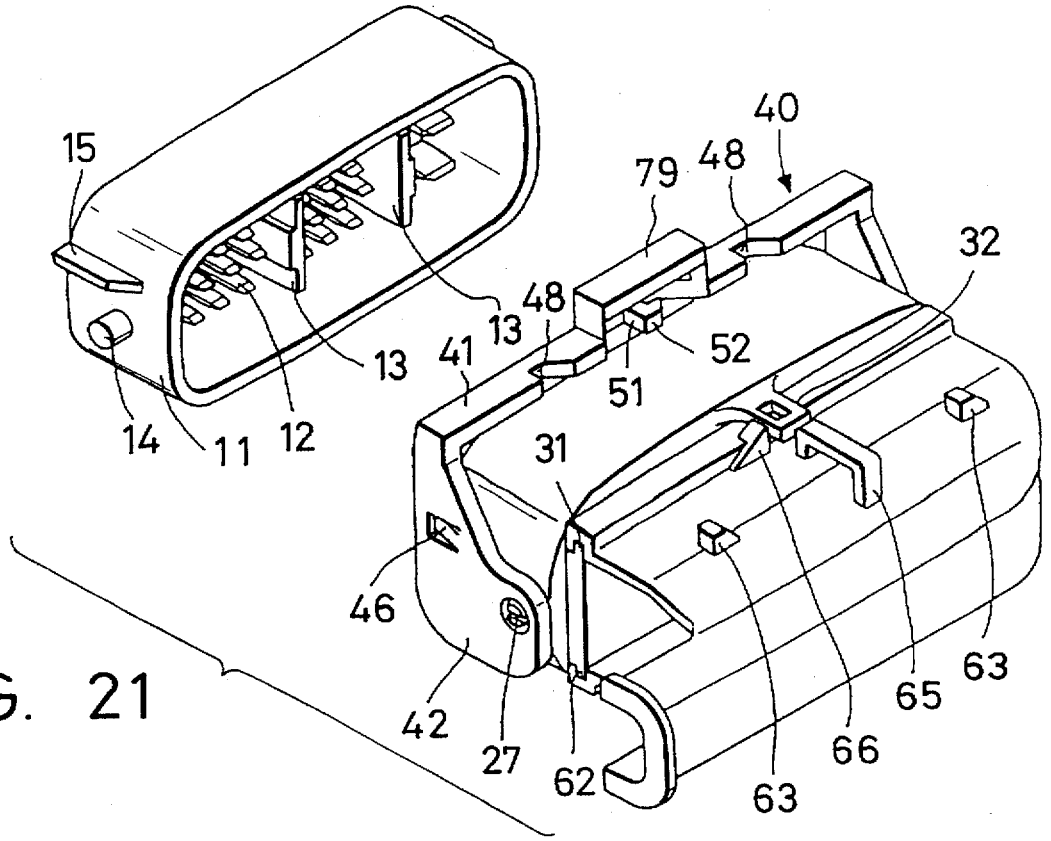
FIG. 21 is a perspective view of a fifth embodiment of the invention, showing a condition before two connectors are fitted together.
Figure 22:
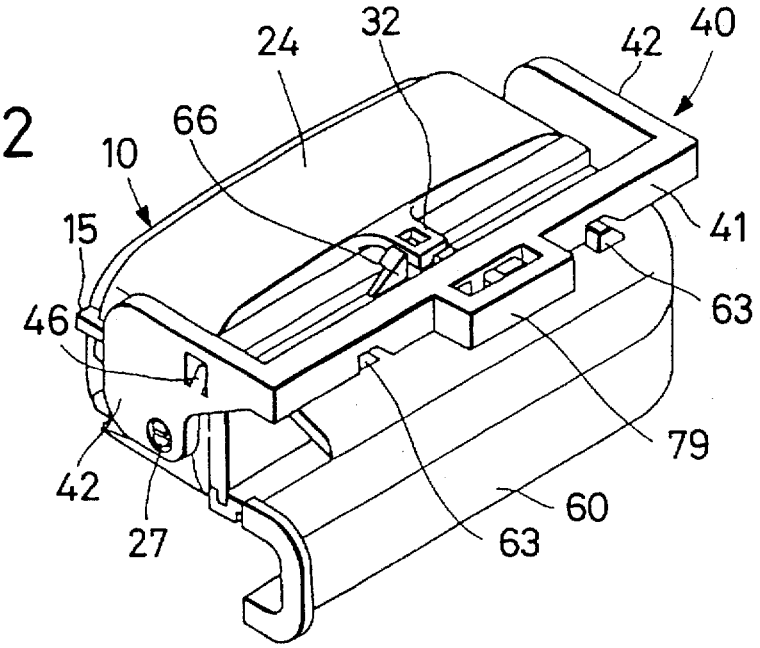
FIG. 22 is a perspective view of the fifth embodiment, showing a condition in which the two connectors are fitted together.

FIG. 19 shows a third lock mechanism of the present invention which also differs from the first specific construction of a lock mechanism. The other construction is similar to that of the first embodiment, and therefore identical portions are designated by identical reference numerals, respectively, and detailed explanation thereof will be omitted, and only different portions will be described.

An engagement hole 74 of a rectangular shape is formed through a central portion of a bridge portion 41 of a lever, and an engagement pawl 75 engageable in the engagement hole 74 is formed on and projects from that portion of a wire cover 60 corresponding to the engagement hole 74. As in the second embodiment, an L-shaped hook portion 76 of the engagement pawl 75 extends toward a rear opening 61 of the wire cover 60. The wire cover 60 is attached to a female connector housing 21, and then when the lever 40 is pivotally moved into a fitting completion position, the engagement pawl 75 is elastically deformed, so that the lever 40 is locked there. Then, when the wire cover 60 is slidingly moved in a direction of an arrow, the engagement pawl 75 is disengaged from the engagement hole 74, thereby releasing the locking of the lever 40. With this construction, effects similar to those of the first embodiment can be achieved.

FIG. 14 shows a fourth lock mechanism of the present invention which also differs from the first specific construction of a lock mechanism. The other construction is similar to that of the first embodiment, and therefore identical portions are designated by identical reference numerals, respectively, and detailed explanation thereof will be omitted, and only different portions will be described.

Instead of the hook portion 65 in the first embodiment, an engagement pawl 77 is formed on and projects from a wire cover 60, and a hook portion 78 of this engagement pawl 77 is so directed as to face an engagement pawl 51. With this construction, effects similar to those of the first embodiment can be achieved.

Figure 15:
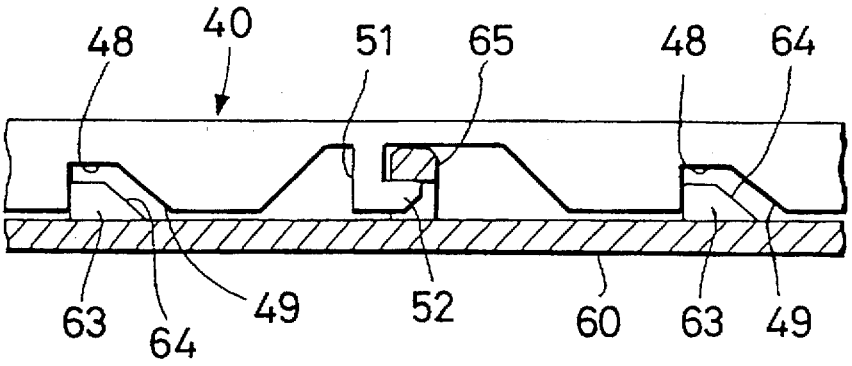
FIG. 15 is an enlarged, cross-sectional view showing a lock-operative condition of a lock mechanism.
Figure 16:
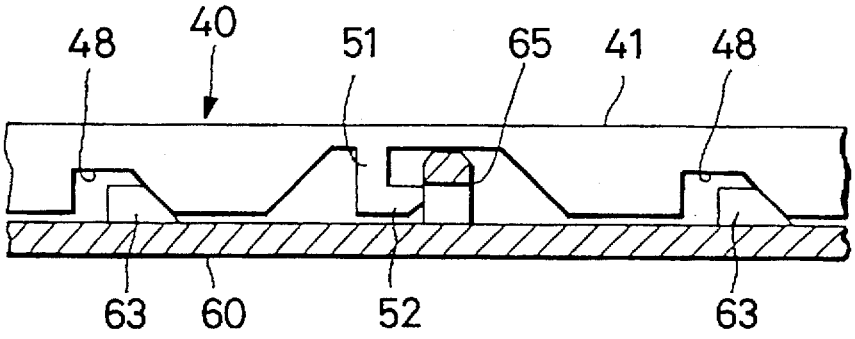
FIG. 16 is an enlarged, cross-sectional view showing a condition in which the locking by the lock mechanism is released.
Figure 17:
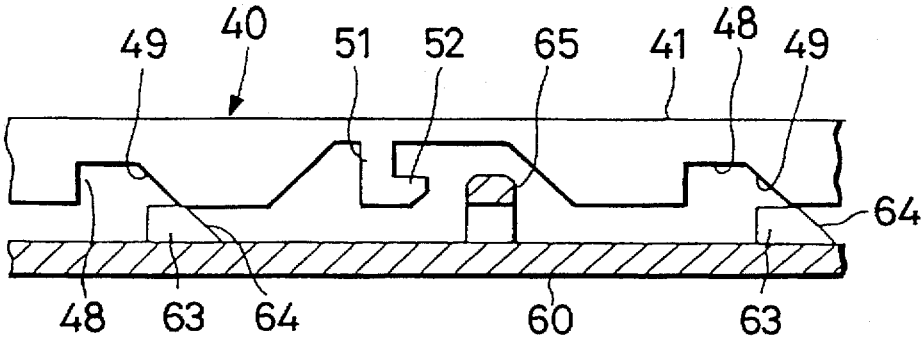
FIG. 17 is an enlarged, cross-sectional view showing an operative condition of a cam mechanism portion.

FIGS. 15 and 16 show a fifth lock mechanism of the present invention which differs from the first embodiment in that a protective frame 79 for protecting an engagement pawl 51 from one side thereof is formed integrally on a bridge portion 41 of a lever 40. The other construction is similar to that of the first embodiment, and therefore identical portions are designated by identical reference numerals, respectively, and detailed explanation thereof will be omitted.

With this construction, effects similar to those of the first embodiment can be obtained, and there is also achieved another advantage that even if a wire is caught by the engagement pawl 51 during transportation or handling before the fitting of the connectors, so that a strong force acts on the engagement pawl 51, the engagement pawl 51 is positively prevented from being damaged.

The present invention is not to be limited to the above structures, and for example the following modifications can be made, and these modifications fall within the scope of the invention.

In each of the above embodiments, although the lock mechanism 54 is constituted using the wire cover 60 as the auxiliary member, the provision of the wire cover 60 is not essential. In the case where the wire cover 60 is not provided, an auxiliary member is movably mounted on the female connector housing 21, and a lock mechanism for locking the lever in the fitting completion position is provided between this auxiliary member and the lever.

The pivotal movement member is not limited to the lever shown in the above embodiments, and for example it may comprise a simple flat plate having only one leg portion, or may comprise a disk-shaped plate having a pivotal movement-operating portion and a cam-acting portion. In short, the pivotal movement member is applied to the connector in such a manner that it is pivotally mounted on one of the connector housings through the support shaft for fitting the two connectors together and for disconnecting them from each other.

Figure 23:
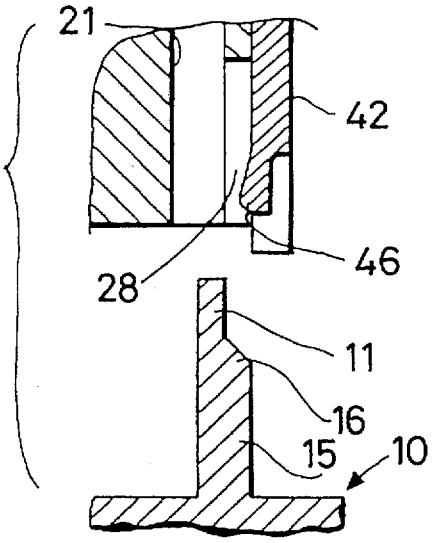
FIG. 23 is an enlarged, cross-sectional view showing a condition in which the lever is held in a fitting-starting position by a retaining mechanism.

Next, it will be described an operation of the elastic projections 46 of the lever 40 to restrict the movement of the lever 40 from the fitting-starting position. It is assumed that the lever 40 is disposed in the fitting-starting position as shown in FIG. 1. In this condition, each elastic projection 46 of the lever 40 is engaged in the associated engagement hole 26 in the hood portion 24 as shown in FIG. 23, so that the lever 40 is prevented from free pivotal movement. Therefore, in this condition, even when the connector is transported, or a wire harness is assembled, there is no fear that the lever 40 is displaced from the fitting-starting position.

In order to enable the two connectors to be fitted together, the cam-acting pins 14 of the male connector housing 11 are engaged respectively in the cam grooves 45 in the lever 40 through the respective guide slits 25 in the female connector housing 21. Here, since the lever 40 is positively held in the fitting-starting position as described above, each cam-acting pin 14 can be easily fitted in an inlet portion of the associated cam groove 45.

Figure 24:
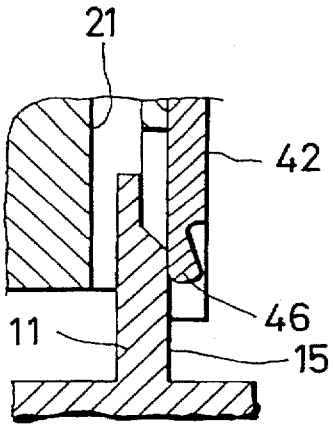
FIG. 24 is an enlarged, cross-sectional view showing a condition in which the holding by the retaining mechanism is released.

When each cam-acting pin 14 is fitted in the inlet portion of the associated cam groove 45, the front end portion of the male connector housing 11 is slightly fitted in the female connector housing 21, and also each engagement release piece portion 15 enters the associated engagement hole 26 in the hood portion 24. Therefore, each elastic projection 46 is forced out of the engagement hole 26 by the associated engagement release piece portion 15 as shown in FIG. 24, so that the retaining of the lever 40 is released, thereby allowing the pivotal movement of the lever 40.

Then, when the lever 40 is pivotally moved from the fitting-starting position toward the fitting completion position, the male connector housing 11 is displaced to be fitted deeper into the female connector housing 21 by the cam action achieved by the cam grooves 45 in the lever 40 and the cam-acting pins 14 on the male connector housing 11, and finally the two connector housings are completely fitted together. In this fitting operation, each elastic projection 46 of the lever has been already disengaged from the associated engagement hole 26 as described above, and therefore only the resistance to the fitting of the terminals 12 into the terminals 22 is exerted, so that the lever can be easily operated to be pivotally moved.

When the lever 40 is pivotally moved into the fitting completion position, the hook portion 65 of the wire cover 60 is engaged with the engagement pawl 51 of the lever 40, thereby locking the lever 40 in this position (see FIG. 4). For disconnecting the two connectors from each other, the wire cover 60 is first moved in the direction of the arrow (FIG. 4), so that the locking is released, and also the cam projections 63 of the wire cover 60 urge the lever 40 upwardly. As a result, the lever 40 is slightly pivotally moved toward the fitting-starting position, and is held in a lifted condition. Therefore, the finger can be easily engaged with the lever.

Next, it is described the provisionally-retaining of the cam-acting pin 14 into the cam groove 45.

In the above construction, the two connectors are fitted together in the following manner.

First, the lever 40 is set in the fitting-starting position as shown in FIG. 1. In this condition, the introduction passage **45*b* of each cam groove 45 is disposed in registry with the associated guide slit 25 in the female connector housing 21, and also each elastic projection 46 of the lever 40 is engaged in the associated engagement hole 26 in the hood portion 24, thereby holding the lever 40** in the fitting-starting position.

Figure 26:
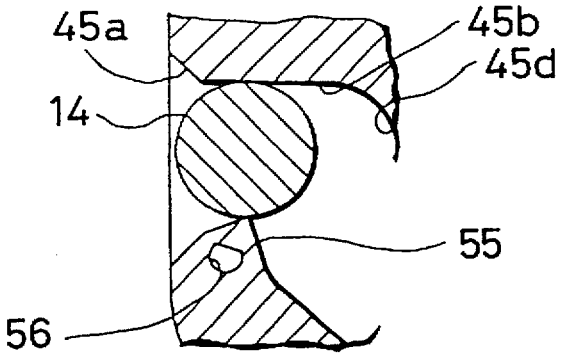
FIG. 26 is a cross-sectional view showing a condition in which a cam-acting pin is in the process of passing past a provisionally-retaining projection.

Then, the front end portion of the male connector housing 11 is slightly pushed into the hood portion 24 of the female connector housing 21. As a result, each cam-acting pin 14 of the male connector housing 11 is introduced into the introduction passage **45*b* of the associated cam groove 45 through the outer open end 45*a*. At this time, the cam-acting pin 14 elastically compresses the provisionally-retaining projection 55, projecting into the introduction passage 45*b*, and passes past this projection 55, and then strikes against the impingement stopper wall portion 45*d* at the inner end of the introduction passage 45*b* to be stopped at the provisionally-fitted position. During the passage of the cam-acting pin 14, the provisionally-retaining projection 55 is easily compressed because of the provision of the recess 56 to allow the cam-acting pin 14 to pass past it, as shown in FIG. 26. After the cam-acting pin 14 thus passes, the provisionally-retaining projection 55 is elastically restored into its initial shape to project into the introduction passage 45*b*, and therefore the cam-acting pin 14 will not be disengaged from the introduction passage 45*b* through the outer open end 45*a***.

When the cam-acting pin 14 is to be forced into the provisionally-retaining position, it passes past the provisionally-retaining projection 55 while elastically deforming this projection 55, and therefore the projection 55, immediately after passed past the projection 55, may strike hard against the impingement stopper wall portion **45*d* at the inner end of the introduction passage 45*b*. In this embodiment, however, the axis of pivotal movement of the lever 40 (that is, the axes of the support shaft 27 and the support shaft insertion hole 43) is disposed on the line passing through the provisionally-retaining position along the direction of fitting of the two connectors, and therefore even if the cam-acting pin 14 strikes hard against the impingement stopper wall portion 45*d*, an angular moment will not act on the lever 40. Thus, the lever 40 will not be pivotally moved by the impact produced when the cam-acting pin 14 strikes against the impingement stopper wall portion 45*d*, and therefore the male connector housing 11** will not be displaced toward the fitting completion position.

There are occasions when the connector is transferred with the two connector housings 11 and 21 disposed in the provisionally-fitted condition. In such a case, a strong force may act on the connector to bring the two connector housings 11 and 21 into the completely-fitted position. In this case, also, the cam-acting pin 14 is pressed hard against the impingement stopper wall portion **45*d* of the cam groove 45; however, an angular moment will not act on the lever 40, and therefore the two connector housings 11 and 21** are positively prevented from being fitted together deeper.

For bringing the two connector housings 11 and 21 from the provisionally-fitted condition into the completely-fitted condition, the bridge portion 41 of the lever 40 is held by the hand, and then the lever 40 is pivotally moved into the fitting completion position. As a result, the cam-acting pins 14 and hence the male connector housing 11 are strongly drawn in the fitting direction through the cam grooves 45 in the lever 40, and when the lever 40 reaches the fitting completion position shown in FIG. 4, the terminals in the connector housing 11 are completely connected respectively to the terminals in the connector housing 21.

The two connectors are thus brought into the completely-fitted condition as shown in FIG. 4, and the engagement pawl 51 of the lever 40 is engaged with the hook portion 65 of the wire cover 60 to lock the lever 40, thereby preventing the lever 40 from being accidentally moved back to the fitting-starting position. When the wire cover 60 is moved from the locked position of FIG. 4 in the direction of the arrow, the cam projections 63 forcibly urge the lever 40 upwardly, so that the lever 40 is slightly pivotally moved from the fitting completion position toward the fitting-starting position, and is stopped there, thus forming a gap between the lever 40 and the wire cover 60 as shown in FIG. 6. Therefore, the finger can be easily engaged with the lever 40 even by one-hand operation, and then the lever 40 can be easily pivotally moved toward the fitting-starting position.

As described above, in this embodiment, for holding the two connector housings 11 and 21 in the provisionally-fitted condition, the provisionally-retaining projections 55 are formed on the lever 40 (which is the essential part), and project respectively into the cam grooves 45 so as to retain the cam-acting pins 14. In this construction, unlike the conventional construction in which the two connector housings are held in the provisionally-retained condition by engaging the projection, formed on the outer surface of the female connector housing, with the projection provided within the hood portion of the male connector housing, a sufficient engagement amount can be secured without increasing the size of the connector, and the stable provisionally-retaining force can be obtained. In the above conventional construction, a mold release hole necessary for forming the projection must be formed in the inner portion of the hood portion. In this embodiment, however, such mold release hole is not necessary, and a waterproof effect is enhanced. And besides, not only the provisionally-retaining projections 55 but also the recesses 56 for facilitating the elastic compressive deformation of these projections 55 are provided, and therefore the press-fitting operation can be easily carried out while securing the sufficient provisionally-retaining force, and also the provisionally-retaining projection 55 will not be plastically deformed by undue press-fitting of the cam-acting pin 14. Therefore, the provisionally-fitting operation can be repeated, and also the connector can be used repeatedly.

Particularly in this embodiment, the axis of pivotal movement of the lever 40 is disposed on the line passing through the provisionally-fitted position along the direction of fitting of the two connectors, and therefore even if the cam-acting pin 14 strikes against the impingement stopper wall portion 45*d*, an angular moment will not act on the lever 40, and the lever 40 will not be accidentally pivotally moved, thereby preventing the two connectors from being brought from the provisionally-fitted condition into the deeper fitted-condition.

The present invention is not to be limited to the above embodiment, and for example, the following modifications can be made, and such modifications fall within the scope of the present invention.

Figure 27:
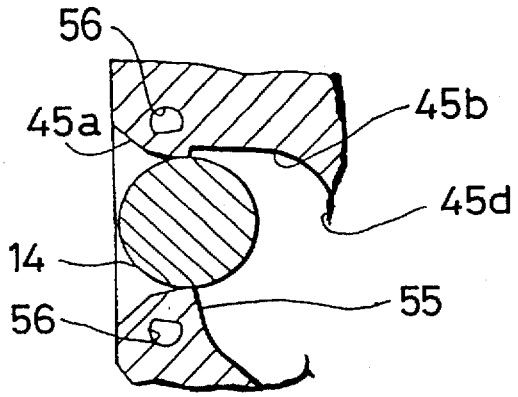
FIG. 27 is an enlarged, cross-sectional view of another embodiment of the invention showing a condition in which the cam-acting pin is in the process of passing past provisionally-retaining projections.

In the above embodiment, although one provisionally-retaining projection 55 projects into each cam groove 45, for example, two provisionally-retaining projections 55 may be formed adjacent to the outer open end 45*a* of the cam groove 45 in opposed relation to each other, as shown in FIG. 27. In this case, recesses 56 are formed adjacent to the two provisionally-retaining projections 55, respectively.

In the above embodiment, although the recess 56 is formed adjacent to the provisionally-retaining projection 55, the recess 56 may be replaced by a through hole so as to facilitate the elastic compressive deformation of the provisionally-retaining projection 55.

In the above embodiment, the lever 40 is mounted on the female connector housing 21, and the cam-acting pins 14 are formed integrally with the male connector housing 11. However, in contrast with this construction, the lever may be mounted on the male connector housing while the cam-acting pins may be formed on the female connector housing. The cam-acting pins do not always need to be formed integrally with the connector housing, and may be formed, for example, on the wire cover attached to the connector housing.

The pivotal movement member is not limited to the lever shown in the above embodiment, and for example it may comprise a simple flat plate having only one leg portion, or may comprise a disk-shaped plate having a pivotal movement-operating portion and a cam-acting portion. In short, the pivotal movement member is to the connector in such a manner that it is pivotally mounted on one of the connector housings through the support shaft for fitting the two connectors together and for disconnecting them from each other.

What is claimed is:

1. A connector comprising:

a first connector housing in which a plurality of terminals are mounted;

a second connector housing in which a plurality of terminals are mounted, said second connector housing being fittable with said first connector housing;

a support shaft formed on and projected from said first connector housing; and a fitting assistance member for removably connecting said first and second connector housings, said fitting assistance member having a support shaft insertion hole to be pivotally engaged with said support shaft;

wherein said support shaft includes:

a split groove in a distal end portion so that said distal end portion is elastically deformable to be reduced in diameter, and a retaining larger-diameter portion formed as part of said distal end portion of said support shaft which is inserted into said support shaft insertion hole, a diameter of said retaining larger-diameter portion being larger than an inner diameter of said support shaft insertion hole.

2. A connector according to claim 1, wherein an inner surface of said support shaft insertion hole is enlarged in a stepped manner to provide a reception recess receiving said retaining larger-diameter portion of said support shaft.

3. A connector according to claim 2, wherein a tapering slanting guide surface is formed at a distal end of said retaining larger-diameter portion, an outer diameter of a distal end of said tapering slanting guide surface being smaller than the inner diameter of said support shaft insertion hole.

4. A connector according to claim 1, wherein a tapering slanting guide surface is formed at a distal end of said retaining larger-diameter portion, an outer diameter of a distal end of said tapering slanting guide surface being smaller than the inner diameter of said support shaft insertion hole.

5. A connector according to claim 1, wherein said support shaft includes a further split groove so as to be a cross-shaped.

6. A connector according to claim 1, wherein said split groove has a V-shaped cross-section.

7. A connector comprising:

a first connector housing in which a plurality of terminals are mounted;

a second connector housing in which a plurality of terminals are mounted, said second connector housing being fittable with said first connector housing;

a support shaft insertion hole formed in said first connector housing;

a fitting assistance member for removably connecting said first and second connector housings, said fitting assistance member having a support shaft to be pivotally mounted in said support shaft insertion hole;

wherein said support shaft includes:

a split groove in a distal end portion so that said distal end portion is elastically deformable to be reduced in diameter, and a retaining larger-diameter portion formed as part of said distal end portion of said support shaft which is inserted into said support shaft insertion hole, a diameter of said retaining larger-diameter portion being larger than an inner diameter of said support shaft insertion hole.

8. A connector comprising:

a first connector housing in which a plurality of terminals are mounted;

a second connector housing in which a plurality of terminals are mounted, said second connector housing being fittable with said first connector housing;

a pivotal movement member mounted on said first connector housing, and operable to be pivotally moved between a fitting-starting position and a fitting completion position, said pivotal movement member being pivotally moved to removably connect said first and second connector housings;

a first engagement member mounted on said pivotal movement member;

an auxiliary member mounted on said first connector housing being displaceable in a direction intersecting to a direction of pivotal movement of said pivotal movement member and having a second engagement member attached to the auxiliary member; and said first engagement member interlocking with said second engagement member forming a lock mechanism thereby engaging said pivotal movement member with said auxiliary member and locking said pivotal movement member in said fitting completion position;

wherein said auxiliary member is displaced to cause said lock mechanism to effect a locking operation and a lock release operation.

9. A connector according to claim 8, wherein said auxiliary member serves also as a wire cover for covering wires extending from said first connector housing.

10. A connector according to claim 8, wherein said first connector housing and said auxiliary member are provided with a retaining mechanism for holding said lock mechanism in its lock-operative condition.

11. A connector comprising:

a first connector housing in which a plurality of terminals are mounted;

a second connector housing in which a plurality of terminals are mounted, said second connector housing being fittable with said first connector housing;

a pivotal movement member mounted on said first connector housing, and operable to be pivotally moved between a fitting-starting position and a fitting completion position, said pivotal movement member being pivotally moved to removably connect said first and second connector housings, said pivotal movement member having a cam surface;

an auxiliary member mounted on said first connector housing and being displaceable relative to said first connector housing, and having a cam projection formed on the auxiliary member;

wherein said cam projection and said cam surface jointly constitute a cam mechanism portion; and said cam mechanism portion displacing said pivotal movement member from said fitting completion position toward said fitting-starting position as a result of a displacement of said auxiliary member.

12. A connector according to claim 11, in which said auxiliary member serves also as a wire cover for covering wires extending from said first connector housing.

13. A connector according to claim 11, in which said first connector housing and said auxiliary member are provided with a retaining mechanism for holding said lock mechanism in its lock-operative condition.

14. A connector comprising:

a first connector housing in which a plurality of terminals are mounted;

a second connector housing in which a plurality of terminals are mounted, said second connector housing being fittable with said first connector housing;

a pivotal movement member mounted on said first connector housing, and operable to be pivotally moved between a fitting-starting position and a fitting completion position, said pivotal movement member being pivotally moved to removably connect said first and second connector housings; and a retaining mechanism provided between said first connector housing and said pivotal movement member for holding said pivotal movement member in said fitting-starting position;

wherein said retaining mechanism includes:

an elastic projection, which is formed integrally with and projects from said pivotal movement member, and extends in a direction of fitting between said first and second connector housings, and an engagement hole for receiving said elastic projection, said engagement hole being formed in said first connector housing, and extending in the direction of fitting between said first and second connector housings, said elastic projection being engaged in said engagement hole when said pivotal movement member is disposed in said fitting-starting position; and wherein said second connector housing has an engagement release piece portion which enters said engagement hole to remove said elastic projection from said engagement hole when said first and second connector housings are fitted together, thereby achieving a released condition.

15. A connector comprising:

a first connector housing in which a plurality of terminals are mounted;

a second connector housing in which a plurality of terminals are mounted, said second connector housing being fittable with said first connector housing;

a pivotal movement member mounted on said first connector housing, and operable to be pivotally moved between a fitting-starting position and a fitting completion position, said pivotal movement member being pivotally moved to removably connect said first and second connector housings;

a cam-acting pin formed on said second connector housing, engageable in a cam groove formed in said pivotal movement member; by fitting said cam-acting pin into a provisionally-fitted position in said cam groove, said two connector housings being held in a provisionally-fitted condition; and said two connector housings being completely fitted together by a cam action achieved by said cam-acting pin and said cam groove in accordance with the pivotal movement of the said pivotal movement member;

a provisionally-retaining projection formed on said pivotal movement member, and projecting into said cam groove, said provisionally-retaining projection being elastically retracted to allow said cam-acting pin to be fitted into a provisionally fitted position when said cam-acting pin is press-fitted into said cam groove; and a recess formed in said pivotal movement member adjacent to said provisionally-retaining projection so as to facilitate an elastic compressive deformation of said provisionally-retaining projection.

16. A connector according to claim 15, wherein an axis of pivotal movement of said pivotal movement member is disposed on a line passing through said provisionally-fitted position along a direction of fitting of said first and second connector housings.

* * * * *